US005408986A

United States Patent [19]

Bigham

[11] Patent Number: 5,408,986

[45] Date of Patent: Apr. 25, 1995

[54] ACOUSTICS ENERGY DISSIPATOR FOR FURNACE

[75] Inventor: Davis L. Bigham, Franklin, Tenn.

[73] Assignee: Inter-City Products Corporation (USA), LaVergne, Tenn.

[21] Appl. No.: 140,609

[22] Filed: Oct. 21, 1993

[51] Int. Cl.[6] ..... F24H 3/02

[52] U.S. Cl. ..... 126/110 R; 431/114; 126/99 A

[58] Field of Search ..... 431/114, 346, 2, 265; 126/99 R, 110 R, 116 R; 181/207, 208, 229; 165/135

[56] References Cited

U.S. PATENT DOCUMENTS

| | | | |
|---|---|---|---|
| 2,089,262 | 10/1937 | Hunter | 158/1 |
| 2,224,130 | 12/1940 | Arnold | 158/1 |
| 3,923,446 | 12/1975 | Budden et al. | 431/114 |
| 3,947,226 | 3/1976 | Neumann | 431/114 |
| 4,168,948 | 9/1979 | Okamoto et al. | 431/114 |
| 4,411,616 | 10/1983 | Neumann | 431/114 |
| 4,476,850 | 10/1984 | Pickering | 126/112 |
| 4,568,264 | 2/1986 | Mullen et al. | 431/1 |
| 4,739,746 | 4/1988 | Tomlinson | 126/110 |
| 4,752,210 | 6/1988 | Trent | 431/20 |
| 4,844,193 | 7/1989 | Veselica et al. | 181/207 |
| 5,094,224 | 3/1992 | Diesch | 126/391 |

FOREIGN PATENT DOCUMENTS

| | | | |
|---|---|---|---|
| 2113028 | 9/1972 | Germany | 126/114 |

*Primary Examiner*—James C. Yeung
*Attorney, Agent, or Firm*—Baker & Daniels

[57] ABSTRACT

The present invention involves a combustion box of a gas furnace which experiences oscillating combustion. The combustion box employs an opening in the housing which is tautly covered with a diaphragm made of elastic material such as silicone rubber. The elastic diaphragm transmits noise and vibration generated by the oscillating combustion of the gas burners in the combustion chamber and thereby dissipates that vibration and noise.

18 Claims, 4 Drawing Sheets

ACOUSTICS ENERGY DISSIPATOR FOR FURNACE

BACKGROUND OF THE INVENTION

1. Field of the Invention

The present invention relates to the combustion box of a gas furnace. More particularly, the field of the invention is that of combustion box construction for gas furnaces utilizing oscillating combustion.

2. Description of the Related Art

Gas furnaces typically have gas burners mounted within a combustion box which provide heated products of combustion to heat exchangers disposed within the plenum of a furnace. The heating function of the furnace is accomplished by circuiting indoor air over these heat exchangers to warm the air prior to its exit from the furnace. A significant problem with many gas furnaces pertains to the occurrence within the combustion box of oscillating combustion, which often generates undesirable acoustical noise and vibration. More specifically, during the operation of gas burners within a combustion box, generation of the products of combustion creates pressure oscillations and an oscillating flame which cause acoustical noise and vibration within the combustion box. Without any compensation for the oscillating combustion, the noise and vibrations generated pass into the heat exchangers, from where they are transmitted to the passing indoor air. This transmission may result in the undesirable noise and vibration penetrating the interior of the building being heated, and causing discomfort to the individuals within the building.

Prior art structures are known which attempt to dampen the noise and vibration resulting from oscillating combustion. These prior art structures involve various dampening or absorbing devices disposed in the combustion box on a wall which oscillates during pressure oscillations in the box. For example, as disclosed in U.S. Pat. No. 4,411,616, an oscillatable wall is disposed in a combustion chamber, such as a flexurally soft thin sheet metal plate backed by a vibration absorbing mass or a rigid plate backed by a sound absorber, to avoid the excitation of combustion chamber oscillations. The flexurally soft wall of a combustion box is backed by a vibration absorbing composition such as a mixture of rubber, tar products, and plastics while the rigid plate is backed by a hydraulic dashpot and mounted by a bellows structure of sheet metal. Other arrangements of vibration absorbing or dampening devices are also known for similar purposes. U.S. Pat. No. 2,224,130 teaches a construction which accounts for pressure oscillations by placing a loosely fitted flexible fabric over a hole of the combustion box so that pressure oscillations are reduced by the movement of the fabric, which changes the effective volume of the combustion chamber. While these prior art devices reduce the effects of oscillating combustion within the combustion chamber, noise and vibration generated within the combustion box which is not absorbed or dampened is communicated into the heat exchangers. Such noise and vibration tends to pass into the indoor air ducts and ultimately into the space being heated. Therefore, it is desirable to provide a combustion chamber wherein noise is removed, communicated, or otherwise dissipated therefrom, without being passed into the heat exchangers.

SUMMARY OF THE INVENTION

The present invention involves a combustion box construction which dissipates noise and vibration. The combustion box is provided with an opening in a wall which is tautly covered with an elastic material such as silicone rubber. During oscillating combustion within the combustion box, noise and vibration are communicated or transferred out of the combustion box through the elastic material or diaphragm rather than being reflected by the box walls and passed into the heat exchangers.

The construction of the combustion box of the present invention finds useful application in gas furnaces which experience oscillating combustion. For example, the diaphragm of the present invention communicates acoustical noise and vibration generated by oscillating combustion due to its elastic and resilient properties. As a result, when the diaphragm vibrates or otherwise rapidly and cyclically bends inward and outward, the diaphragm is taut so that sound and vibration are transmitted to outside the combustion box. Therefore, the construction of the diaphragm and its tautly covering arrangement results in beneficial sound transmitting characteristics for the combustion box. Specifically, noises or sounds not prevented by the vibrating diaphragm are communicated through the diaphragm to outside the combustion box instead of reflecting or otherwise rebounding off the combustion box walls and undesirably passing with the products of combustion into the heat exchanger. Because of the location of the diaphragm, these sounds therefore are released into, for example, a furnace room, where they are less troublesome, rather than into the living quarters where warmed air is conveyed.

The present invention, in one form thereof, involves a furnace comprising a housing, a heat exchanger, a combustion box, an oscillating combustion device, and a transmitting device for transmitting vibration and noise. The heat exchanger, which is disposed in a plenum defined by the housing, is in communication with the combustion box. The oscillating combustion means in the combustion box combusts fuel to heat the heat exchanger with products of combustion and also generates noise and vibration. The transmitting device is disposed in communication with the combustion box to transmit vibration and noise produced by the oscillating combustion device outside the combustion box. The transmitting device employs an elastic material, such as silicone rubber, disposed across an opening in the combustion box.

In another form thereof, the present invention involves a combustion box having a housing, a fuel combustion device within the housing, and a device for communicating acoustical noise. The housing includes an inlet for receiving fuel as well as an outlet in communication with a furnace heat exchanger. Products of combustion created when the combustion device combusts fuel pass through the housing outlet and into the heat exchanger. The combustion device also creates acoustical noise within the housing during operation. The acoustical noise communicating device utilizes an elastic diaphragm covering an opening in the housing to communicate the acoustical noise externally of the housing and externally of the heat exchanger.

In still another form thereof, the present invention involves a combustion box having a housing, a fuel combustion device within the housing, and a device for communicating acoustical noise. The housing, which comprises several exterior walls, has at least one exterior wall with an opening therethrough. In combusting fuel to provide combustion products to heat the heat exchanger, the combustion device produces pressure oscillations and creates acoustical noise within the housing. The acoustical noise communicating device utilizes a diaphragm tautly covering the wall opening to communicate the acoustical noise to outside the housing and to outside the heat exchanger.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

The preferred embodiment disclosed below is not intended to be exhaustive or limit the invention to the precise form disclosed in the following detailed description. Rather, the embodiment is chosen and described so that others skilled in the art may utilize its teachings.

Figure 1:
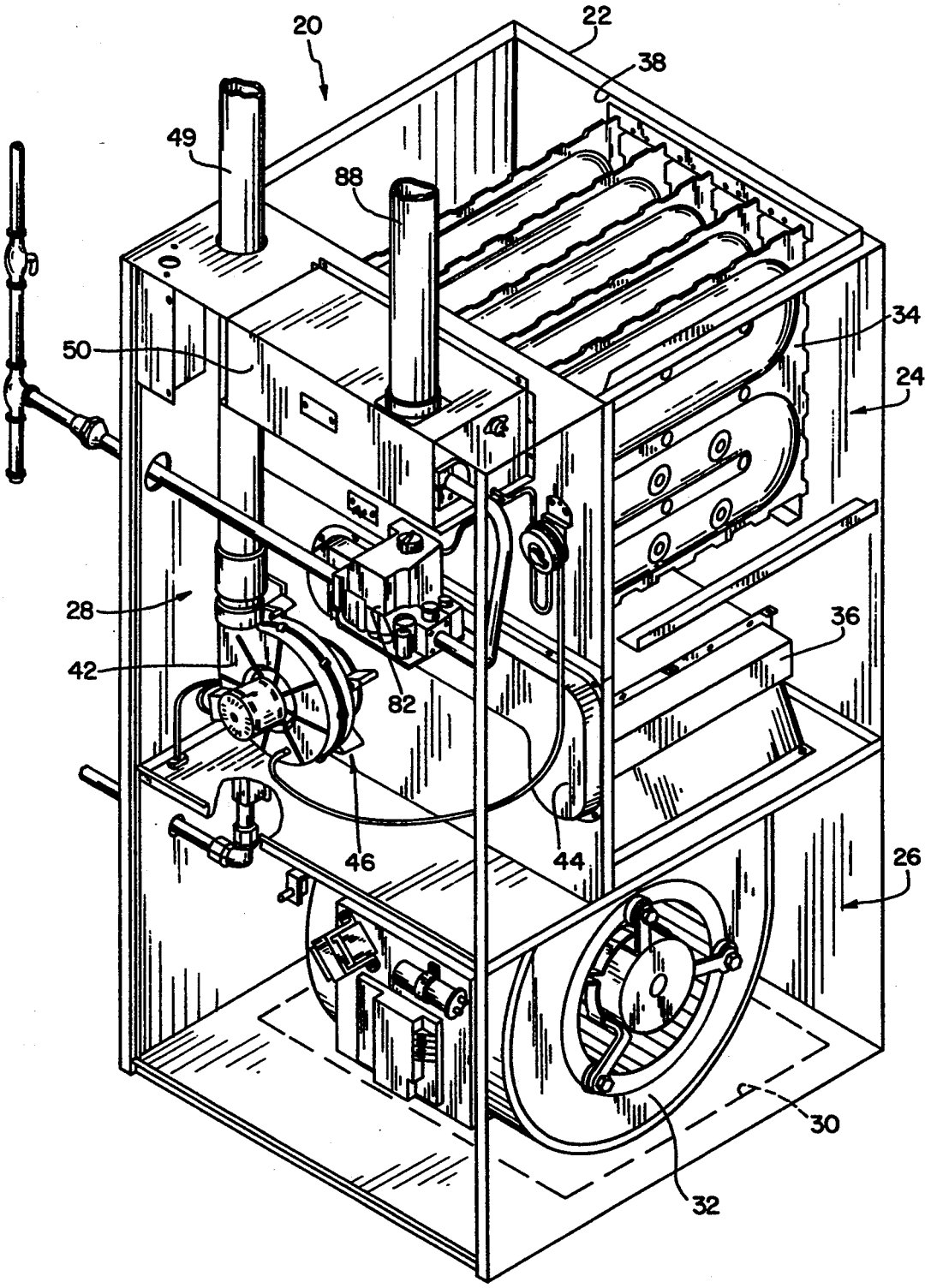
FIG. 1 is a perspective view of a gas furnace having a combustion box made in accordance with the present invention.
Figure 2:
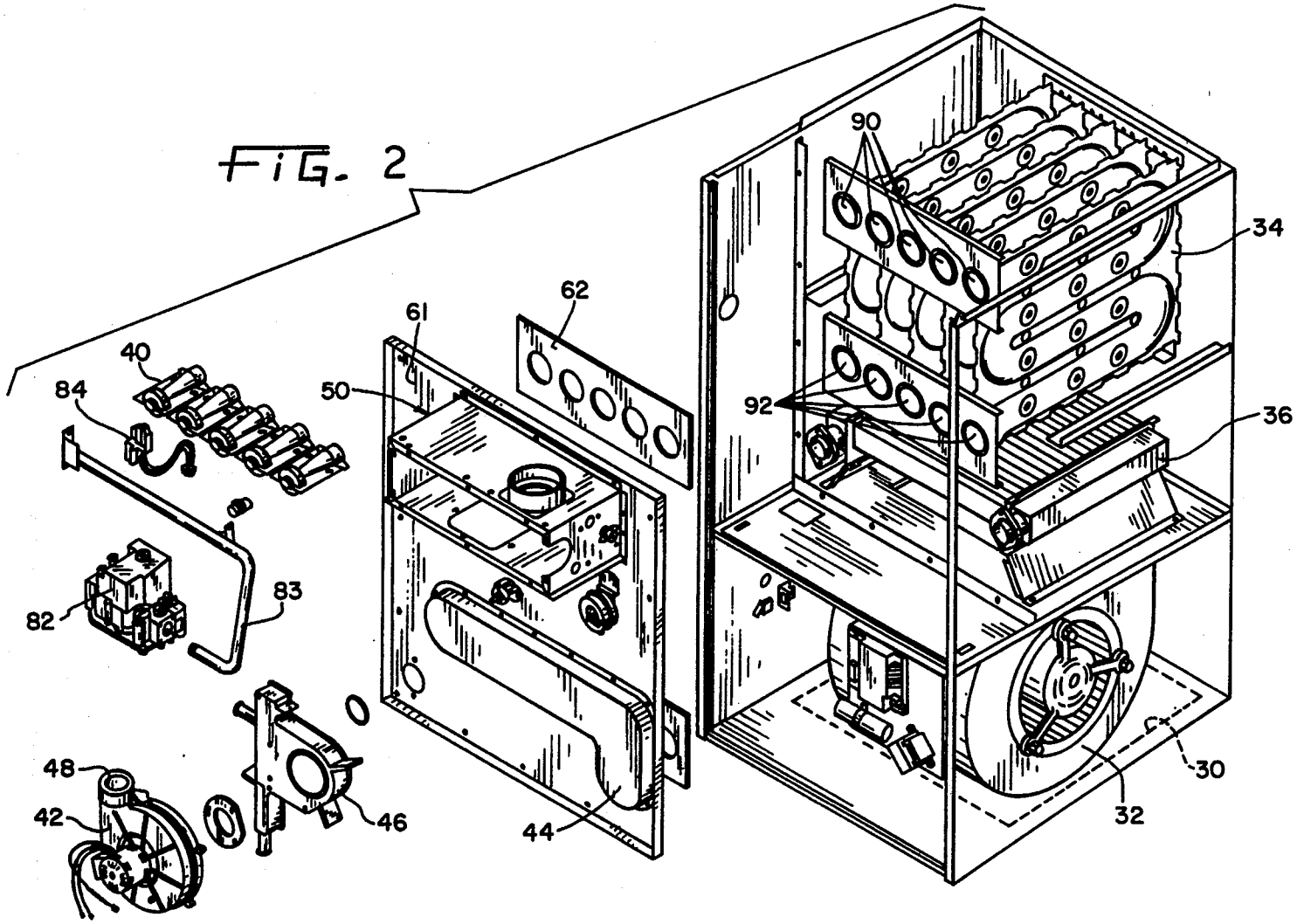
FIG. 2 is an exploded view of the furnace shown in FIG. 1, wherein several components of the combustion box are not shown.

The present invention finds beneficial application in a gas furnace, generally designated 20, which is shown in FIGS. 1 and 2. Housing 22 of furnace 20 is essentially divided into plenum portion 24, circulation portion 26, and vestibule portion 28. As the present invention concerns improvements directed to the combustion box (50) located in vestibule portion 28, the other aspects of furnace 20 are therefore discussed only briefly below.

Referring now to FIGS. 1 and 2, circulation portion 26 includes circulation air inlet 30 and circulation blower 32. Plenum portion 24 includes primary heat exchangers 34, secondary heat exchanger 36, and circulation air outlet 38. In order for furnace 20 to output heated indoor air, circulation blower 32 draws indoor air through air inlet 30 and forces that air over secondary heat exchanger 36 and primary heat exchangers 34, which during operation are heated relative to the inlet air. The gases within the heat exchangers are higher temperature products of combustion created when inshot gas burners 40 within the combustion box, generally designated 50, ignite the fuel and air mixture introduced thereto. Exhaust blower 42 induces the flow of the products of combustion through primary heat exchangers 34, collector box 44, secondary heat exchanger 36, and into transition box 46, which collects condensate as taught in copending U.S. patent application Ser. No. 08/104,859, entitled "CONDENSATE ISOLATOR AND DRAINAGE SYSTEM FOR FURNACE", filed Aug. 11, 1993, and assigned to the assignee of the present invention, the disclosure of which is explicitly incorporated by reference. Exhaust blower 42 includes an inlet (not shown), connected to transition box 46, and an outlet 48, connected to vent pipe 49.

Furnace 20 begins operation by opening gas valve 82, turning on exhaust blower 42, and activating electronic ignition 84. The induced draft created by exhaust blower 42 draws an oxygen source of outdoor air into combustion box 50 through inlet pipe 88. The outdoor air mixes with the gas fuel, which is introduced to gas burners 40 from gas valve 82 by means of conduit 83, and are ignited with electronic ignition 84 within box 50 and combust while entering heat exchanger inlets 90. The products of combustion traverse the internal passageways of heat exchangers 34 and exit through outlets 92 into a spaced defined by collector box 44. In primary heat exchangers 34, a significant portion of the heat of the products of the combustion is transferred to the indoor air being circulated by blower 42. As the products of combustion entering header box 44 still have an appreciable amount of heat remaining, exhaust blower 42 induces these products of combustion through secondary heat exchanger 36. Secondary heat exchanger 36 is designed to transfer the remaining heat from the products of combustion to the indoor air. As a result of this secondary heat transfer, the products of combustion exit secondary heat exchanger 36 at a greatly reduced temperature, and enter transition box 46. The combustion gases then pass into exhaust blower 42 and through outlet pipe 49 to be exhausted to the atmosphere.

Figure 3:
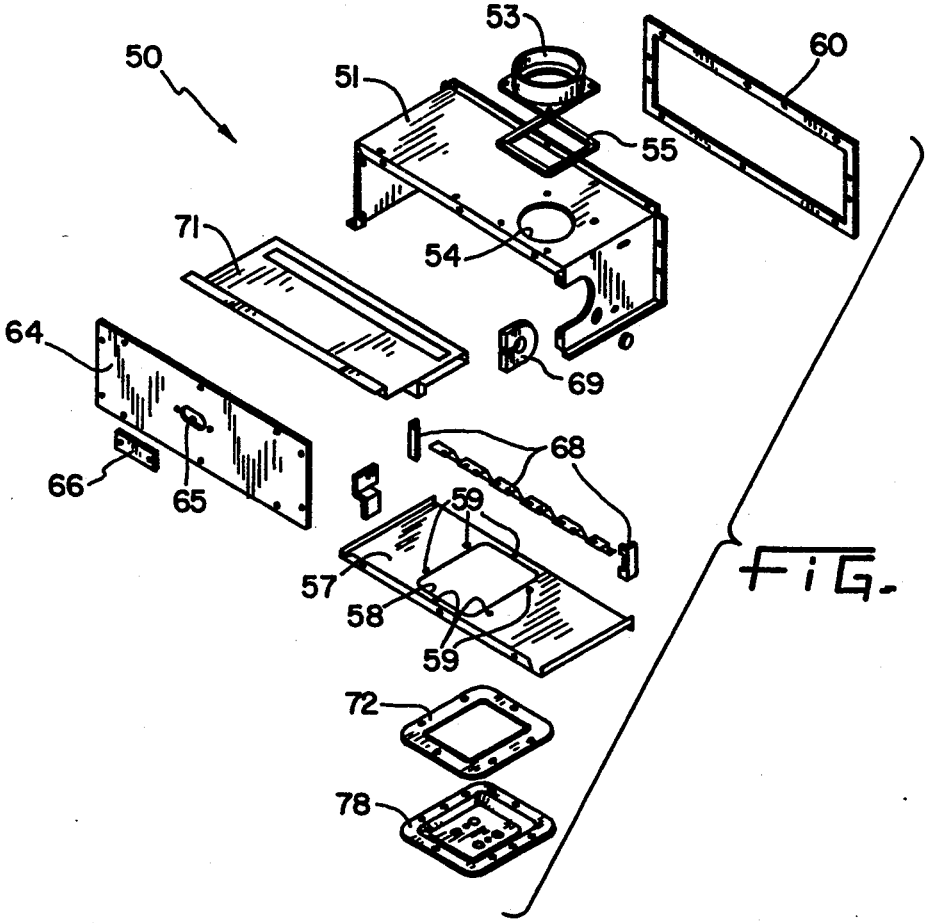
FIG. 3 is an exploded view of the combustion box components omitting the burners and their related components which are disposed in the combustion box of the present invention.

In accordance with the present invention, and with reference now to FIG. 3 as well, the exterior of assembled combustion box 50 is substantially parallelepiped in shape. As used herein, the term "box" is not intended as a description of the geometric configuration of the exterior shape of the combustion chamber or box. Instead, the expression "combustion box" as used herein is a more generic term which merely specifies the apparatus whereat combustion occurs. Thus, combustion boxes with shapes other that the parallelepiped shape shown in FIGS. 1–3, for instance a box with a trapezoidal cross section, are intended to be included within this meaning.

The combustion box housing is primarily formed from three pieces, namely C-shaped top panel member 51, bottom panel member 57, and front panel member 64. Top panel member 51 individually defines the major portions of the top and side walls of box 50. Bottom panel 57 and front panel 64, which respectively serve as the bottom and front walls or surfaces of combustion box 50, can be assembled together along with top panel member 51 with screws or other fasteners. A centered oval opening 65 in front panel 64 is covered by sight glass 66 to allow a person to see into combustion box 50 to verify, for example, that the flame is lit. Pipe coupler 53, sized to receive the end of air inlet pipe 88, is fastened to the top surface of panel member 51 over round opening 54 therein. Mounting seal 55 is inserted between pipe coupler 53 and panel member 51 to help ensure an airtight passageway. The back wall of combustion box 50 is not specifically enclosed with another panel member, but instead is essentially uncovered and serves as an outlet in communication with heat exchangers 34. As shown in FIG. 2, outlet sealing or partition plate 62 provides an airtight fit between combustion box 50 and heat exchanger inlets 90. During furnace operation, products of combustion pass through the outlet formed by the back wall of combustion box 50 to enter and then circulate through heat exchangers 34. Due to the interposition of seal element 60, combustion box 50 can be fastened, around its perimeter, in an airtight manner to divider panel 61 which separates vestibule portion 28 from plenum portion 24.

Inshot gas burners 40 are installed within combustion box 50 by means of bracket assembly 68. Fitting 69, which is received by a complementary shaped notch in the chamber side wall defined by panel member 51, serves as an airtight inlet for conduit 83, which brings fuel to burners 40. Baffle plate 71, positioned within the assembled combustion box at a location above burners 40, distributes to burners 40 the outside air introduced via inlet pipe 88.

Focusing on an advantageous feature of the present invention which allows for noise and vibration within the combustion box 50 to be communicated, transmitted, or otherwise transferred to outside the box and away from the heat exchangers, combustion box 50 employs a square shaped opening 58 with rounded corners centered both lengthwise and widthwise in bottom panel 57. Threaded holes 59, disposed around opening 58, receive the screws which allow for the stacked securement of diaphragm 72 and pressure port plate 78 to the bottom surface of panel 57.

Figure 4:
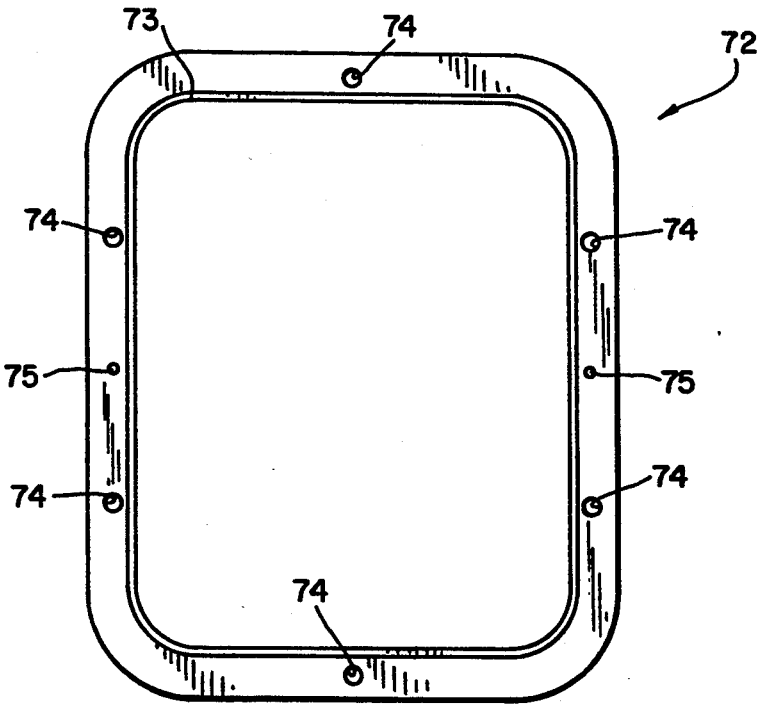
FIG. 4 is bottom view of the diaphragm shown in FIG. 3.

As shown in FIGS. 3 and 4, diaphragm 72 is formed from an elastic and resilient material in a one-piece construction. The outer perimeter of diaphragm 72 is shaped similar to and extends over opening 58. Holes 74 are positioned around the perimeter of diaphragm 72 at locations so as to be aligned with holes 59 in bottom panel 57. Although essentially flat in cross section, diaphragm 72 includes an integral rib portion 73 which encircles an interior area of diaphragm 72 which is essentially coextensive with the perimeter of opening 58. Rib 73, which is positioned to contact the edge of opening 58 when diaphragm 72 is secured to bottom panel 57, provides diaphragm 72 with an increased thickness to minimize the chance of tearing due to the repeated shifting or rubbing of diaphragm 72 against the metal bottom panel 57 when experiencing vibratory motion during furnace operation. The interior area of diaphragm 72 surrounded by rib 73 is uniformly thick in cross section and sized to tautly cover opening 58 when diaphragm 72 is secured to bottom panel 57. When properly secured, diaphragm 72 completely covers opening 58 to provide an airtight seal so as to not allow any products of combustion to escape through opening 58. The tautness of the instant diaphragm is believed to provide better sound and vibration transmitting properties than a diaphragm which is loosely disposed, or in other words disposed with excess folds or flaps of materials, over an opening. Rib 73 is circular in cross section and centered within the thickness or depth of diaphragm 72. A pair of opposing frustoconical projections 75, which positively locate diaphragm 72 in relation to plate 78, are disposed on the side of diaphragm 72 facing plate 78.

Figure 5:
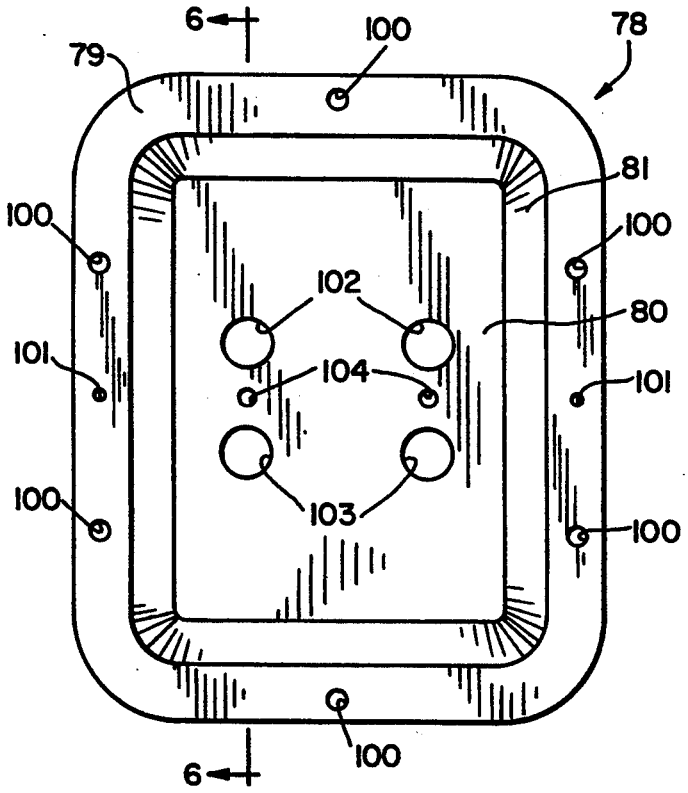
FIG. 5 is bottom view of the pressure port plate shown in FIG. 3.
Figure 6:
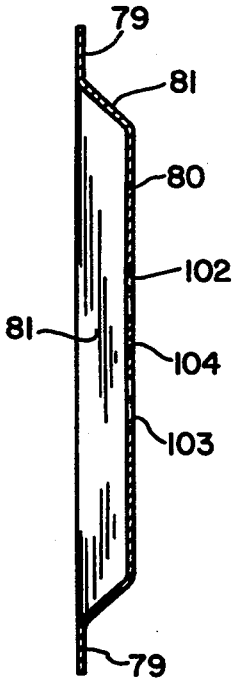
FIG. 6 is a sectional view of the pressure port plate taken along view line 6–6 of FIG. 5.

Referring now to FIGS. 5 and 6, pressure port plate 78 is designed to substantially cover and thereby protect diaphragm 72, which vibrates inward and outward during furnace operation. Plate 78 prevents a person from contacting and accidentally tearing or puncturing diaphragm 72, which may allow combustion gases to escape into the furnace room. Plate 78 also prevents an object from being placed directly against or too close to diaphragm 72, which could hinder vibratory motion of the diaphragm and thereby frustrate its sound transmitting function. Plate 78 is fabricated in one-piece from galvanized steel and constructed with a two-tiered surface. The outer region of pressure port plate 78 comprises a flat coupling surface 79, which includes mounting holes 100 aligned with both diaphragm holes 74 and bottom panel holes 59. When plate 78 is attached to box 50 in stacked arrangement with diaphragm 72, coupling surface 79 sandwiches the region of diaphragm 72 outside rib 73 against the bottom surface of panel 57 to frictionally secure or maintain diaphragm 72 in place. A pair of smaller holes 101 are also provided within coupling surface 79 to receive frustoconical projections 75 and thereby properly align diaphragm 72 in relation to plate 78. Centrally disposed projecting surface 80, which is integrally connected with coupling surface 79 by means of sloped region 81, is disposed in a plane parallel to coupling surface 79. Two pairs of larger diameter apertures 102 and 103 are formed in projecting surface 80 and allow sound and vibration to pass therethrough. Another pair of smaller circular openings 104 is present between apertures 102 and 103. It will be appreciated that the space defined between the upper side of centrally disposed projecting surface 80 and diaphragm 72 accommodates the outward bending of diaphragm 72 when it vibrates during furnace operation.

In the preferred embodiment, the material of diaphragm 72 is silicone rubber, for example, silicone rubber sold under the tradename of Viton rubber. The silicone rubber preferably has a 60 Shore A Durometer hardness and resistance to the radiant heat of gas burners 40, which typically ranges between 300° F. to 350° F. If the durometer hardness is too high, diaphragm 72 will not satisfactorily transfer the sound and vibration within box 50. Diaphragm 72, but for rib 73 and frustoconical projections 75, is preferably constructed of a uniform 0.91 millimeter thickness. Rib 73 is preferably 2.2 millimeters in diameter, and each projection 75 preferably has a base portion flush with the diaphragm surface with a diameter of 3.6 millimeters and an outward portion 2.0 millimeters in diameter. The material of the combustion box cover, in other words diaphragm 72, may be of any suitable elastic material which has the desired sound and vibration transmitting properties. The use of silicone rubber in the preferred embodiment is due partially to the location of the cover in close proximity to the radiant energy produced within the combustion box. Silicone rubber retains its noise and vibration transmitting properties even when exposed to such amounts of radiant energy. However, the location of the opening and corresponding diaphragm cover of the combustion box may be such that the cover would not be disposed in such close proximity to the radiant energy, so that other materials could be used, such as neoprene rubber or other material with similar noise and vibration transmitting properties.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A furnace comprising:

a housing defining a plenum;

a heat exchanger disposed in said plenum;

a combustion box having an opening and disposed in communication with said heat exchanger;

combustion means for oscillatingly combusting fuel in said combustion box and heating said heat exchanger with products of combustion, said combustion means generating vibration and noise within said combustion box; and transmitting means for transmitting said vibration and noise outside said combustion box through said opening, said transmitting means comprising a diaphragm tautly disposed across said opening in communication with said combustion box.

2. The furnace of claim 1 wherein said diaphragm comprises an elastic material.

3. The furnace of claim 2 wherein said elastic material of said transmitting means comprises silicone rubber.

4. The furnace of claim 1 further comprising a port plate disposed over said opening and having at least one aperture therethrough.

5. The furnace of claim 4 wherein said diaphragm comprises an elastic material, and said port plate comprises a projecting surface spaced apart from said elastic material.

6. A combustion box for use in a furnace having a heat exchanger, said combustion box comprising:

a housing including an inlet for receiving fuel, and an outlet in communication with the furnace heat exchanger;

combustion means for combusting fuel within said housing and creating products of combustion which pass through said housing outlet into the heat exchanger, said combustion means further creating acoustical noise within said housing; and means for communicating the acoustical noise externally of said housing and externally of the heat exchanger, said communicating means comprising an elastic diaphragm tautly disposed across an opening in said housing.

7. The combustion box of claim 6 wherein said housing comprises a plurality of walls including a bottom wall, and wherein said bottom wall includes said housing opening.

8. The combustion box of claim 6 wherein said elastic diaphragm comprises silicone rubber.

9. The combustion box of claim 6 further comprising a port plate disposed across said housing opening, said port plate having at least one aperture therethrough.

10. The combustion box of claim 9 wherein said port plate comprises a projecting surface spaced apart from said elastic diaphragm.

11. The combustion box of claim 9 wherein said port plate is of a one-piece construction.

12. A combustion box for heating a heat exchanger in a furnace, said combustion box comprising:

a housing having a plurality of exterior walls, at least one of said exterior walls having an opening therethrough;

combustion means for combusting fuel within said housing to provide combustion products to circulate within the heat exchanger, said combustion means further producing pressure oscillations and creating acoustical noise within said housing; and means for communicating the acoustical noise externally of said housing and externally of the heat exchanger, said communicating means comprising a diaphragm tautly covering said wall opening.

13. The combustion box of claim 12 wherein said diaphragm comprises an elastic material.

14. The combustion box of claim 13 wherein said elastic material comprises silicone rubber.

15. The combustion box of claim 14 wherein said silicone rubber diaphragm has around a 60 Shore A Durometer hardness.

16. The combustion box of claim 12 further comprising a port plate disposed across said wall opening, said port plate having at least one aperture therethrough.

17. The combustion box of claim 16 wherein said port plate comprises a projecting surface spaced apart from said elastic diaphragm.

18. The combustion box of claim 16 wherein said port plate is of a one-piece construction.

* * * * *